United States Patent [19]

Coyle

[11] 4,184,220

[45] Jan. 22, 1980

[54] CONDUIT CLEANER

[76] Inventor: Thomas M. Coyle, 1 Hale Ct., Tonawanda, N.Y. 14150

[21] Appl. No.: 971,230

[22] Filed: Dec. 20, 1978

[51] Int. Cl.[2] ..... B08B 9/04

[52] U.S. Cl. ..... 15/104.2; 15/104.3 SN

[58] Field of Search ..... 15/104.09, 104.12, 104.16, 15/104.2, 104.3 R, 104.3 SN; 134/167 C

[56] References Cited

U.S. PATENT DOCUMENTS

| | | | |
|---|---|---|---|
| 2,601,691 | 7/1952 | Dyer | 15/104.2 |
| 3,678,948 | 7/1972 | Hedges | 134/167 C |

*Primary Examiner*—Edward L. Roberts

*Attorney, Agent, or Firm*—Sommer & Sommer

[57] ABSTRACT

A conduit cleaner, particularly adapted to clean sewer lines and remove tree roots therefrom, includes a tube connected to a hose supplied with pressurized water, a jet nozzle on the tube's other end, and forward and rearward guides separated by an intermediate brush. The guides and brush are severally mounted on the tube for independent rotational and limited sliding movement relative to the tube. The jet nozzle has a plurality of openings, which direct jets of discharged water rearwardly toward the distal ends of the brush's bristles. In use, the conduit cleaner is pulled rearwardly through a conduit while the water jets continuously flush the brush. The cleaner has been found effective to dislodge accumulated caked materials, and, with relatively stiff tine-like bristles, to shear tree roots which have penetrated the conduit.

14 Claims, 4 Drawing Figures

CONDUIT CLEANER

BACKGROUND OF THE INVENTION

1. Field of the Invention

The present invention relates generally to apparatus for cleaning conduits and more particularly to an improved device for cleaning sewers and removing tree roots therefrom.

2. Description of the Prior Art

Tree roots are perhaps one of the most difficult problems encountered in the maintenance of sewer lines. Other waste products, such as soap, will provide a cake which will accumulate on the inside of a sewer. However, this can be removed by known techniques. Other materials, such as sand and grit, can be effectively moved along the sewer by a water flush technique toward a manhole, through which such materials may be vacuum removed.

Tree roots, however, continue to be one of the most difficult problems. The known "bucket" technique was effective in removing such roots, but this technique was relatively slow. In some cases, only about 300 lineal feet of sewer could be adequately cleaned per day.

More recently, others have proposed various rotary devices. Examples of these are shown in U.S. Pat. Nos. 3,134,120; 1,634,591; 4,011,100; 2,162,677; 3,872,533; 1,036,735; 3,525,112; 2,062,850; and 3,740,785. These devices have generally contemplated that a tool, such as a root-cutting saw or a brush, be forcibly rotated relative to a body member. The problem, however, is that the body member is not held fast. Hence, when the tool encountered an object, the tool might embed itself in the object, and cause the body member to rotate relative to the stationary tool.

When known types of jet nozzle-flush techniques are employed, it has been found that the tree roots will sway in the fluid stream. Hence, this technique might be effective to clean the tree root of accumulated matter, but is not effective to actually cut and remove the penetrating roots.

SUMMARY OF THE INVENTION

The present invention provides an improved conduit cleaner, which is adapted to be connected to the end of a hose supplied with pressurized fluid from a suitable source thereof.

The improved conduit cleaner broadly includes an elongated tube having one marginal end portion connected to the hose and having another marginal end portion; a jet nozzle mounted on the tube other end and having a plurality of openings through which fluid supplied through the hose end tube may be discharged rearwardly to exert a reaction force on the nozzle and to propel such assembly forwardly along a conduit to be cleaned; and a brush encircling the tube and having a plurality of tine-like bristles extending radially outwardly therefrom. The brush is arranged such that the distal ends of the bristles are arranged in the path of the fluid jets discharged rearwardly from the nozzle openings. The cleaner may be propelled forwardly along the conduit by the reaction force exerted by such discharged fluid jets, or by other means, and may be pulled rearwardly along the conduit by the hose, or by other means, by overcoming this reaction force, to brush matter adhering to the inner surface of the conduit and to shear roots penetrating the same.

The brush may be mounted fast to the tube, or may be mounted for free rotational and limited sliding movement relative thereto. If desired, one or more guides may be mounted on the tube, either ahead of or behind the brush, or both.

Accordingly, the general object of the present invention is to provide an improved device for cleaning a conduit.

Another object is to provide an improved device for cleaning a sewer, and for removing penetrant tree roots therefrom.

Another object is to provide an improved root-cutting sewer cleaner which is structurally uncomplicated, and which results in a more facile combination than that heretofore available.

These and other objects and advantages will become apparent from the foregoing and ongoing written specification, the drawings, and the appended claims.

DESCRIPTION OF THE PREFERRED EMBODIMENTS

Figure 1:
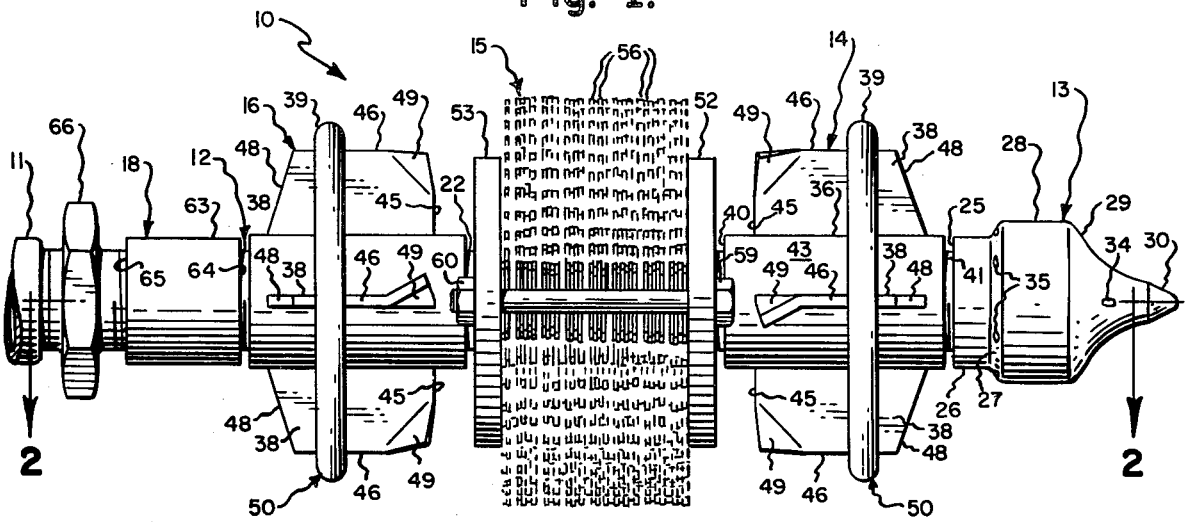
FIG. 1 is a top plan view of the inventive conduit cleaner, this view showing the jet nozzle, the forward guide, the brush, the rearward guide, and the collar.

At the outset, it should be clearly understood that like reference numerals are intended to identify the same elements and/or structure consistently throughout the several drawing figures, as such elements and/or structure may be further described or explained by the entire written specification of which this detailed description is an integral part.

Referring now to the drawing figures, and more particularly to FIG. 1 thereof, the invention provides an improved conduit cleaner, of which the presently preferred embodiment is generally indicated at 10. The conduit cleaner 10 herein disclosed is adapted to be connected to the end of a hose 11 supplied with pressurized fluid, normally water, from a suitable source (not shown) thereof. While the term "conduit", as used herein, is intended in its broadest generic sense, the inventive conduit cleaner 10 is particularly suited for use in cleaning sewer lines and for removing tree root obstructions therefrom. However, it should be clearly understood that the inventive cleaner 10 is not limited to this particular field of use, but may be employed to clean, brush or scrub other types of conduits, such as pipes, tubes, mains, feeder lines, and the like, as well.

In FIG. 1, the conduit cleaner is shown as including: a horizontally-elongated tube, generally indicated at 12; a forwardmost jet nozzle, generally indicated at 13; a forward guide, generally indicated at 14; a brush, generally indicated at 15; a rearward guide, generally indicated at 16; and a rearwardmost coupling, generally indicated at 18.

Figure 2:
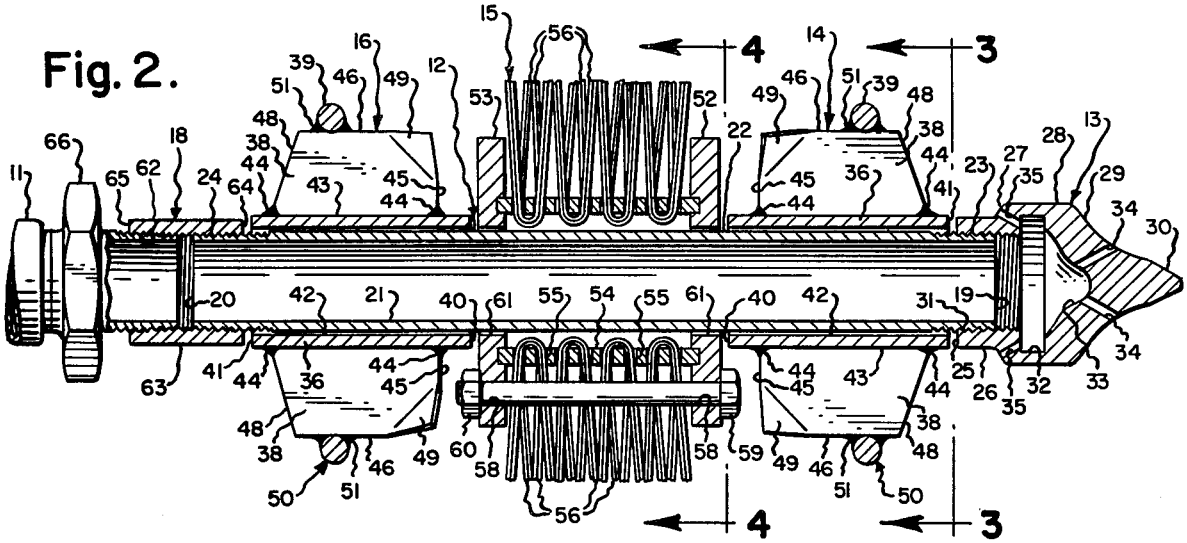
FIG. 2 is a fragmentary axial vertical sectional view thereof, taken generally on line 2—2 of FIG. 1, this view particularly showing the manner by which the guides, brush, nozzle and coupling are mounted on the tube.

As best shown in FIG. 2, the tube 12 is a horizontally-elongated pipe-like member having an annular vertical front end face 19; an annular vertical rear end face 20; a cylindrical inner surface 21; and a cylindrical outer surface 22 provided with externally-threaded front and rear marginal portions 23, 24, respectively.

The jet nozzle 13 is shown as being a specially-configured member having an annular vertical rear end face 25; an outer surface including (from left to right in FIG. 2) a cylindrical portion 26, a convex portion 27 extending outwardly and forwardly therefrom, a cylindrical portion 28 extending forwardly therefrom and preferably provided with a pair of diametrically-opposite parallel planar surfaces on "flats" (not shown), by which the nozzle may be gripped by a suitable tool (not shown), a convex portion 29 extending forwardly and inwardly therefrom, and terminating in a forwardmost pointed nose 30; and an inner surface including (from left to right in FIG. 2), an internally-threaded portion 31, an annular recess 32 extending radially into the nozzle wall and having a substantially U-shaped cross-section, and a concave portion 33. As best shown in FIG. 2, a pair of diametrically-opposite forward nozzles or orifices, severally indicated at 34, are provided between nozzle portions 29, 33 to spray fluid on the walls of the conduit ahead or forwardly of the jet nozzle. A plurality of circumferentially-spaced rearward nozzles or orifices, severally indicated at 35, are provided between nozzle portions 28, 32 to direct jets of discharged fluid rearwardly and to exert a reaction force on the cleaner for propelling the same forwardly (i.e., rightwardly in FIGS. 1 and 2) along the conduit. While some of the forward reaction force exerted on the nozzle by fluid discharged through nozzle rear openings 35 will be needed to cancel the rearward reaction force exerted on the nozzle by fluid discharged through nozzle front openings 34, the number, size and spacing of the nozzle rear openings 35 is designed such that the net effect will be to propel the entire cleaner 10 forwardly along the conduit. In the preferred embodiment, six of nozzle openings 35 are provided, and these are directed and circumferentially spaced from one another so as to not impart rotational movement to the nozzle and tube. The nozzle 13 is commercially available, and is not individually claimed herein, except as part of a larger combination. While persons skilled in this art will recognize nozzle 13 as being a type of "penetrator nozzle", such persons will also appreciate that other types of nozzles, such as a "sand nozzle", a "15° nozzle", a "35° nozzle", a "grease nozzle", a "lance nozzle", a "bullet nozzle", and the like, may be readily substituted for nozzle 13.

Figure 3:
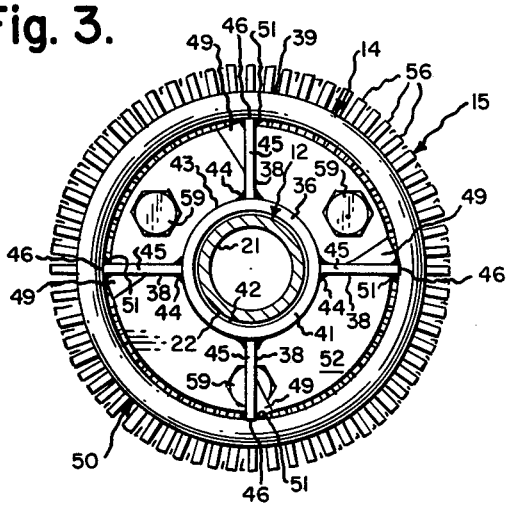
FIG. 3 is a fragmentary transverse vertical sectional view thereof, taken generally on line 3—3 of FIG. 2, and showing the forward guide in front elevation.
Figure 4:
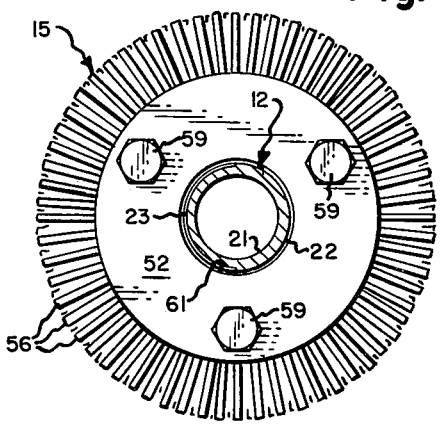
FIG. 4 is a fragmentary transverse vertical sectional view thereof, taken generally on line 4—4 of FIG. 2, and showing the brush in front elevation.

Referring now to FIGS. 1–3, collectively, the forward guide 14 is shown as including a tubular sleeve 36, a plurality of fins, severally indicated at 38, and a segment 39 connecting an adjacent pair of fins. As best shown in FIG. 2, the sleeve 36 has an annular vertical rear end face 40; an annular vertical front end face 41; an inner cylindrical surface 42 of a larger diameter than but arranged to face tube outer surface 22; and an outer cylindrical surface 43. In the preferred embodiment, four of plate-like fins 38 are welded at 44 to the sleeve outer surface 43 at equally-spaced ninety degree intervals. Each fin is mounted so as to imaginarily intersect the tube axis, and extends radially outwardly from the sleeve. In FIGS. 1 and 2, each fin 38 is shown as appearing to have a generally trapezoidal outline (when viewed in side elevation) having a rearward vertical surface 45, an outer horizontal surface 46, and a forwardly-and inwardly-inclined leading surface 48. In the preferred embodiment, a triangular portion of each fin, between fin surfaces 45, 46 is inclined to provide a vane 49 which may cause the forward guide to rotate about the tube when fluid is discharged rearwardly through nozzle jet openings 35. In the preferred embodiment, the segment 39 is a portion of an annular ring, generally indicated at 50, which is shown as being welded at 51 to each fin. The function of annular ring 50 is two fold: first, it provides a measure of circumferential stability to the distal ends of the fins; and, secondly, the ring provides a means by which a cable may be readily attached to the cleaner, as by a clevis, to pull the cleaner forwardly. The provision of vanes 49 on the fins is optional, and may be omitted if desired.

The brush 15 is shown as including a forward annular disc-like member 52; a rearward annular disc-like member 53 spaced longitudinally from member 52, an intermediate cylindrical collar 54 provided with a large member of holes or perforations 55, and a plurality of V- or U-shaped stiff tine-like elements providing individual bristles 56. Each of disc-like members 52 has three openings 58 therethrough, these being arranged at 120° intervals, to accommodate passage of a headed bolt-fastener 59, which is retained in the position shown in FIG. 2 by a suitable nut 60. Each disc-like member 52, 53 is provided with an axial through opening bounded by a cylindrical surface 61 which is diametrically larger than but arranged to face a portion of the tube. Hence, the brush is mounted on the tube for both independent rotational and limited axial sliding movement relative thereto.

The rear guide 16 is structurally identical to the forward guide, albeit its position is shown as being reversed. Inasmuch as the structure of the front guide has been previously described, it is not deemed necessary to repeat such description for the rear guide. However, the corresponding parts, portions and surfaces of the rear guide are identified by the same reference numerals heretofore used to describe the front guide.

The coupling 18 is shown as being of conventional design, and is internally-threaded at 62, has an outer cylindrical surface 63, and has front and rear annular vertical end faces 64, 65, respectively. In FIGS. 1 and 2, this coupling 18 is shown as operatively connecting the tube rear marginal end portion with a suitable adapter 66 mounted on the end of hose 11.

OPERATION

The inventive conduit cleaner may be used in association with a known sewer cleaner, generally truck or trailer mounted, which provides a source of highly pressurized water, and means for vacuuming the displaced sludge and debris.

To clean a sewer between two adjacent manholes, the manhole covers are first removed. Thereafter, a known device, including a jet nozzle, is lowered into the sewer pipe and is propelled therealong to advance the hose from one manhole to the other. At the other manhole, this known device is removed, and the inventive conduit cleaner 10 is substituted thereof. If desired, a cable may be attached to the annular ring 50 of the forward guide. Thereafter, the device is lowered down the other manhole and is supplied with highly pressurized water. At the same time, the cleaner 10 is pulled rearwardly by the hose, or by a cable attached to the rear guide, toward the first manhole. At any particular location, or along the length of the section to be cleaned, the cleaner may be reciprocated in the sewer by alternatively pulling the hose, and alternately allowing the jet nozzle to advance the cleaner forwardly. The cable may be used to pull the cleaner forwardly, when and if it becomes stuck or its freedom of movement is impeded.

Actual use has proven the inventive cleaner 10 to be highly effective in removing both caked material, such as soap, accumulated on the inside of the sewer pipe, and tree roots which have penetrated the sewer. One unique feature of the inventive cleaner is that when it is pulled rearwardly, the rearward nozzle jets are directed toward the distal ends of the bristles to flush away dislodged material and to maintain the operative efficiency of the bristles. When tine-like bristles of sufficient stiffness are used, it has been found that the cleaner is effective in shearing tree roots which have a diameter approximately the size of a man's finger. While heretofore, the known bucket technique for cleaning sewers and removing tree roots therefrom, would be expected to clean approximately 300 feet per day, it has been found that use of the foregoing cleaner will permit lengths of sewer pipe on the order of 1000 feet per day to be cleaned, depending largely on the extent of root penetration. This rate compares favorably with other systems which use a jet nozzle and hose to flush the sewer. However, while such other system has been found to remove cake material, it does not remove the roots. In effect, the roots are cleaned, but not removed.

While the most common type of fluid employed is water, the invention contemplates that other types of liquid or gaseous fluids might be used. Desriably, the various component parts of the inventive cleaner are formed of high strength steel, or even stainless steel, if desired. The cleaner may be readily disassembled for cleaning or to replace worn or broken parts. By permitting both rotational and limited sliding movement of the forward guide, the brush, and the rearward guide relative to the tube, a degree of freedom is maintained so that the cleaner does not become stopped by a relatively small obstruction. However, this need not invariably obtain. For example, either guide and/or the brush may be mounted fast to the tube, if desired. Hence, the preferred embodiment herein disclosed is structurally simple, readily permits assembly and disassembly, is effective in dislodging caked material, and, most importantly, has been found to be effective in shearing tree roots which have penetrated the sewer pipe.

Therefore, while a preferred embodiment of the inventive cleaner has been shown and described, and several modifications thereof discussed, persons skilled in this art will appreciate that various additional changes and modifications may be made without departing from the spirit of the invention, which is defined by the following claims.

What is claimed is:

1. A conduit cleaner adapted to be connected to the end of a hose supplied with pressurized fluid from a suitable source thereof, said conduit cleaner comprising:

an elongated tube having one marginal end portion connected to said hose and having another marginal end portion;

a jet nozzle mounted on such tube other marginal end portion, said jet nozzle having a plurality of rearwardly-directed openings through which fluid supplied through said hose and tube may be discharged to exert a reaction force on said nozzle and to propel such assembly forwardly along a conduit to be cleaned; and a brush encircling said tube rearwardly of said nozzle, said brush having a plurality of bristles extending radially outwardly therefrom, said brush being arranged such that the distal end portions of said bristles are arranged in the path of fluid discharged rearwardly through said nozzle openings;

whereby, said cleaner may be pulled rearwardly along said conduit by overcoming said reaction force, to brush matter adhering to the inner surface of said conduit and to shear roots penetrating the same.

2. A conduit cleaner as set forth in claim 1 wherein said brush includes a collar encircling said tube.

3. A conduit cleaner as set forth in claim 2 wherein said collar is rotatably mounted on said tube.

4. A conduit cleaner as set forth in claim 1, and further comprising:

a forward guide mounted on said tube between said brush and nozzle.

5. A conduit cleaner as set forth in claim 4 wherein said forward guide includes a sleeve encircling said tube, a plurality of fins extending outwardly from said sleeve, and a segment connecting any two adjacent fins.

6. A conduit cleaner as set forth in claim 5 wherein said segment is a portion of an annular ring concentric with said sleeve and secured to said fins.

7. A conduit cleaner as set forth in claim 5 wherein said sleeve is rotatably mounted on said tube.

8. A conduit cleaner as set forth in claim 7 wherein at least one of said fins has a portion thereof inclined to provide a vane which will cause said forward guide to rotate when fluid is discharged from said nozzle openings.

9. A conduit cleaner as set forth in claim 1 and further comprising:

a rearward guide mounted on said tube between said brush and hose.

10. A conduit cleaner as set forth in claim 9 wherein said rearward guide includes a sleeve encircling said tube, a plurality of fins extending outwardly from said sleeve, and a segment connecting any two adjacent fins.

11. A conduit cleaner as set forth in claim 10 wherein said segment is a portion of an annular ring concentric with said sleeve and secured to said fins.

12. A conduit cleaner as set forth in claim 10 wherein said sleeve is rotatably mounted on said tube.

13. A conduit cleaner as set forth in claim 12 wherein at least one of said fins has a portion thereof inclined to provide a vane which will cause said rearward guide to rotate when fluid is discharged from said nozzle openings.

14. A conduit cleaner as set forth in claim 1 wherein said brush is mounted for longitudinal sliding movement along said tube, and further comprising:

a forward sleeve encircling said tube and arranged between said brush and nozzle;

a rearward sleeve encircling said tube and arranged rearwardly of said brush; and a coupling interposed between said hose and tube to provide limits for such longitudinal sliding movement of said brush relative to said tube.

* * * * *